US005590423A

United States Patent [19]

Boykin

[11] Patent Number: 5,590,423

[45] Date of Patent: Jan. 7, 1997

[54] COMMODE ODOR EXTRACTOR

[76] Inventor: Dwight L. Boykin, 200 Wheeler Rd., Bay Minette, Ala. 36507

[21] Appl. No.: 571,542

[22] Filed: Dec. 13, 1995

[51] Int. Cl.[6] ..... E03D 9/04

[52] U.S. Cl. ..... 4/213

[58] Field of Search ..... 4/213, 216, 217, 4/348–352

[56] References Cited

U.S. PATENT DOCUMENTS

| | | | |
|---|---|---|---|
| 1,862,085 | 7/1932 | Hertzog | 4/213 |
| 2,167,152 | 7/1939 | Henschler | 4/213 |
| 2,309,885 | 2/1943 | Carman | 4/213 |
| 2,824,313 | 2/1958 | Bulow | 4/213 |
| 2,847,682 | 8/1958 | Shay | 4/213 |
| 3,335,431 | 8/1967 | Coates | 4/213 |
| 3,763,505 | 10/1973 | Zimmerman | 4/352 X |
| 3,916,459 | 11/1975 | Ivancevic | 4/213 |
| 5,010,600 | 4/1991 | Prisco | 4/217 |
| 5,136,729 | 8/1992 | Ricard | 4/213 |
| 5,161,262 | 11/1992 | Quaintance, Sr. | 4/213 |
| 5,199,111 | 4/1993 | Antepenko | 4/213 |

*Primary Examiner*—Charles E. Phillips
*Attorney, Agent, or Firm*—Joseph N. Breaux

[57] ABSTRACT

An odor extractor for commodes including a U-shaped suction fitting having an interior lip that extends into the commode bowl between one-half and one inch and a plurality of suction apertures each formed through a bottom surface thereof and in connection with a central suction chamber; a dual port vent hose fitting having two connecting ports adapted for connection with a venting hose; a momentary contact switch extending from an upper surface of the U-shaped suction fitting; a first and second commode attachment plate, having a mounting aperture formed therethrough for allowing passage of an existing commode seat attachment bolt therethrough; a vent hose having a hose fitting connectable with either of the ports of the vent hose fitting; and a port plug sealingly connectable with either of the ports of the vent hose fitting.

18 Claims, 1 Drawing Sheet

COMMODE ODOR EXTRACTOR

TECHNICAL FIELD

The present invention relates to devices used to capture and vent odors and more particularly to devices used to capture and vent odors that are connectable to a portion of a commode bowl perimeter that have an activation switch actuated by a weight applied to the existing commode seat.

BACKGROUND ART

Removing odorous gasses released during defecation from the bathroom area is generally accomplished by venting the entire contents of the bathroom to the attic or out of the building entirely. Although such room venting can eliminate odors permeating the room after a period of time, room venting does nothing to address the problem of eliminating the spread of the odor throughout the room. It would be a benefit, therefore, to have a venting device that could be utilized in conjunction with a venting assembly that could capture and direct odorous bathroom gasses out through a venting system prior to the spread of the gasses throughout the bathroom. It would be a further benefit if the device could capture the odorous gasses prior to the escape of the gas from the commode bowl. It would also be a benefit if the device were easily installed on existing commodes and was adapted for use with a vent line running on either side of the commode. In addition, because a venting system is only effective if used, it would also be desirable to have a switch that could be connected to the venting system that activated the venting system automatically once a person sat on the commode seat.

GENERAL SUMMARY DISCUSSION OF INVENTION

It is thus an object of the invention to provide a commode odor extractor connectable with a venting assembly that could capture and direct odorous bathroom gasses out through the venting assembly prior to the spread of the odorous gasses throughout the bathroom.

It is a further object of the invention to provide a commode odor extractor that captures the odorous gasses prior to the escape of the gas from the commode bowl.

It is a still further object of the invention to provide a commode odor extractor that is easily installed on existing commodes.

It is a still further object of the invention to provide a commode odor extractor that may be used with a vent line running on either side of the commode.

It is a still further object of the invention to provide a commode odor extractor that includes a switch that may be connected in series with the power supply line of the venting system during installation that activates the venting system when a person sits on the seat of the commode.

It is a still further object of the invention to provide a commode odor extractor that accomplishes all or some of the above objects in combination.

Accordingly, a commode odor extractor is provided. The odor extractor includes a U-shaped suction fitting having an interior lip that extends into the commode bowl between one-half and one inch and a plurality of suction apertures each formed through a bottom surface thereof and in connection with a central suction chamber; a dual port vent hose fitting, in connection with the central suction chamber, having two connecting ports adapted for connection with a venting hose and a cable aperture; a momentary contact switch extending from an upper surface of the U-shaped suction fitting and having an insulated electrical connection cable routed through the central fitting, into the vent hose fitting and out through the cable aperture of the vent hose fitting; a first and second commode attachment plate, having a mounting aperture formed therethrough for allowing passage of an existing commode seat attachment bolt therethrough, each of the first and second attachment plates extending between the U-shaped suction fitting and the vent hose fitting and extending past a bottom surface of the U-shaped fitting at least one-sixteenth inch; a vent hose having a hose fitting connectable with either of the ports of the vent hose fitting; and a port plug sealingly connectable with either of the ports of the vent hose fitting. The U-shaped suction fitting is preferably constructed from electrically non-conductive plastic. In a preferred embodiment, the vent hoses connection fitting does not have a cable aperture, and the insulated electrical connection cable is threaded through the vent hose back to the vent assembly.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
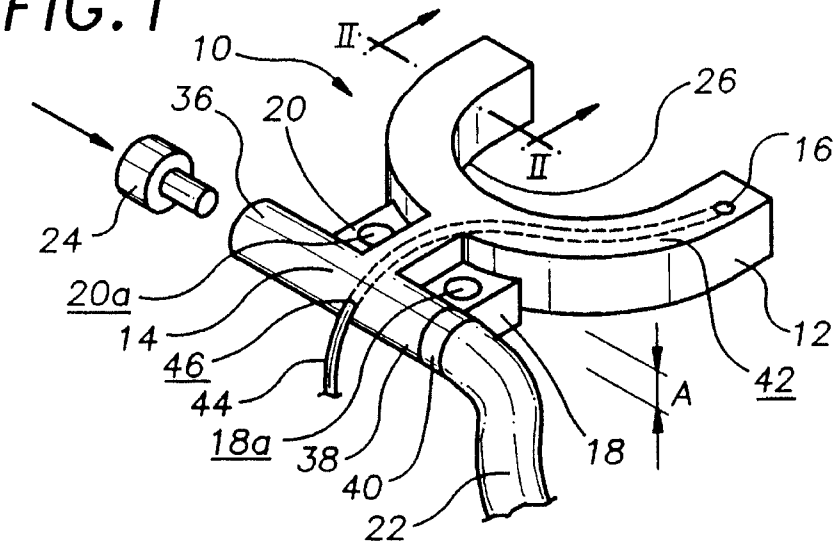
FIG. 1 is a perspective view of an exemplary embodiment of the commode odor extractor of the present invention showing the momentary contact switch provided on the top surface of the suction fitting.

FIG. 1 shows an exemplary embodiment of the commode odor extractor of the present invention generally designated by the numeral 10. Odor extractor 10 includes a U-shaped suction fitting 12, a dual port vent hose fitting 14, a momentary contact switch 16, a first and second commode attachment plate 18, 20, a vent hose 22, and a port plug 24.

Figure 2:
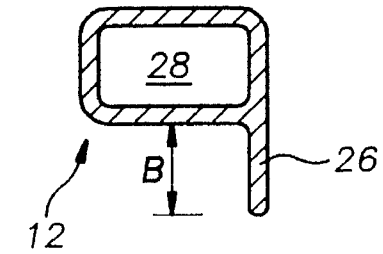
FIG. 2 is a cross-section view of the suction fitting of the exemplary embodiment of FIG. 1 along the line II—II.
Figure 3:
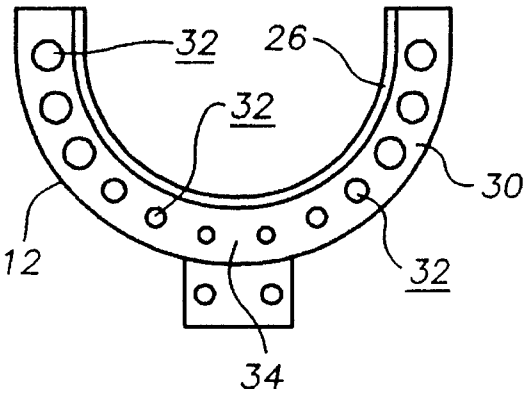
FIG. 3 is a plan view of the underside of the odor extractor of FIG. 1 showing the twelve suction apertures and the two securing apertures.

U-shaped suction fitting 12 is constructed from a non-conducting plastic and is sized to allow placement thereof between a commode seat and the top surface of a commode bowl rim during installation and operation. A lip 26, more clearly shown in FIG. 2, extends downwardly from the main body of U-shaped suction fitting 12 a distance "B" of about one-half inch. Also shown in FIG. 2 is a central suction chamber 28 that extends substantially the entire length of U-shaped suction fitting 12. With reference to FIG. 3, the bottom surface 30 of U-shaped suction fitting 12 has twelve suction apertures 32. The diameter of suction apertures 32 increase in size as the distance between the suction aperture 32 and the center 34 of U-shaped suction fitting 12 increase. Lip 26 is also shown in the figure, running along the entire internal edge of U-shaped suction fitting 12.

With reference once again to FIG. 1, dual port vent hose fitting 14 includes a first and second internal threaded port 36,38. The internal airflow passageway of vent hose fitting 14 is in connection with central chamber 28. First internally threaded port 36 is shown with port plug 24 removed. Port plug 24 may be threaded into either the first or second internally threaded ports 36,38 to seal the port from airflow therethrough. Vent hose 22 includes a hose fitting 40 that is also threadably connectable to either of first or second internally threaded ports 36,38. By making vent hose 22 connectable to either threaded port 36,38, odor extractor 10 may be used under conditions requiring routing of vent hose 22 along either side of the commode.

Also shown in FIG. 1 is momentary contact switch 16. Momentary contact switch 16 extends from a top surface 42 of U-shaped suction fitting 12. A connecting cable 44 is routed through central chamber 28 into the internal airflow passageway of vent hose fitting 14 and out through a cable aperture 46. Although this odor extractor 10 includes a cable aperture 46, connecting cable 44 may be routed through vent hose 22 in the manner previously discussed. When this option is chosen, cable aperture 46 may be plugged internally with a section of tape or externally with a snap-in cable aperture plug which may be provided with odor extractor 10 if desired.

First and second commode attachment plates 18,20 each have a mounting aperture 18*a*,20*a* formed therethrough for allowing passage of the existing commode seat attachment bolts. Odor extractor 10 is attached by removing the existing seat/cover assembly, placing mounting plate apertures 18*a*, 20*a* over the existing seat/cover mounting apertures and then attaching the seat/cover assembly with the existing commode seat attachment bolts. As shown in the figure, first and second attachment plates 18,20 each extend beneath U-shaped suction fitting 12 and vent hose fitting 14 a distance "A" of about one-eighth inch. The one-eighth inch clearance allows air within the commode bowl to enter suction apertures 32 through the one-eight inch gap provided between bottom surface 30 of U-shaped suction fitting 12 and the top of the commode bowl rim.

Figure 4:
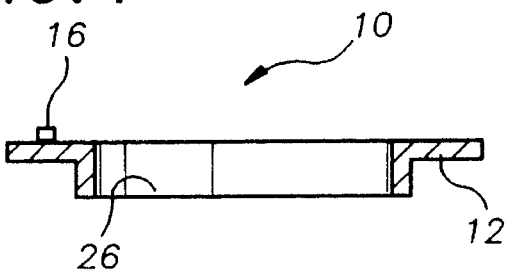
FIG. 4 is a plan view of the odor extractor from the front.
Figure 5:
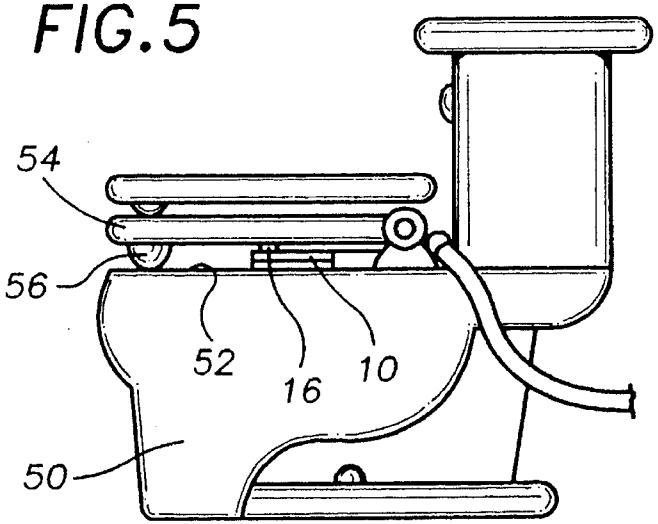
FIG. 5 is a plan view of the odor extractor of FIG. 1 shown installed on a representative commode between the rim of the commode bowl and a conventional commode seat.

FIG. 4 is a plan view of odor extractor 10 from the front showing lip 26 extending down from U-shaped suction fitting 12. Also shown is momentary contact switch 16. FIG. 5 is a plan view of odor extractor 10 installed on a representative commode 50 between the rim 52 of the commode bowl and commode seat 54. As shown in the figure, momentary contact switch 16 is positioned adjacent the underside of commode seat 54. When a person sits on commode seat 54, commode seat bumper 56 compresses enough to allow commode seat 54 to actuate momentary contact switch 16. When switch 16 is actuated, and the vent assembly wired thereto during installation is activated—drawing air and airborne odors from the commode blow into suction apertures 32, through contact chamber 28, through the internal airflow passageway of hose fitting 14, through vent hose 22, into the vent assembly and out through the exhaust vent of the vent assembly into a desired exhaust location.

It can be seen from the preceding description that a commode odor extraction has been provided that is connectable with a venting assembly, that captures the odorous gasses prior to the escape of the gas from the commode bowl, that is easily installed on existing commodes, that may be used with a vent line running on either side of the commode, and that includes an automatic activating switch that is connectable to the venting system during installation that activates the venting system when a person sits on the seat of the commode.

It is noted that the embodiment of the commode odor extractor described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A commode odor extractor comprising:

a U-shaped suction fitting having a central suction chamber defined in part by an upper and lower surface and having a lip on said lower surface that extends into an interior of a commode bowl a distance of a between one-half and one inch, said fitting having a plurality of suction apertures each formed through said bottom surface thereof and in communication with said central suction chamber;

a dual port vent hose fitting connected to said central suction chamber and having two connecting ports adapted for connection with a venting hose and having a cable aperture therein;

a momentary contact switch extending from said upper surface of said U-shaped suction fitting and having an insulated electrical connection cable running through said central chamber and into said vent hose fitting and out through said cable aperture of said vent hose fitting;

a first and second commode attachment plate having a mounting aperture formed therethrough for allowing passage of an existing commode seat attachment bolt therethrough, each of said first and second attachment plates extending between said U-shaped suction fitting and said vent hose fitting and extending past said bottom surface of said U-shaped fitting at least one-sixteenth of an inch such that upon mounting said plates on a commode, said bottom surface will be elevated said at least one-sixteenth of an inch above said commode to allow passage of air from said commode into said central suction chamber via said suction apertures;

a vent hose having a hose fitting connectable with either of said ports of said vent hose fitting in a manner such that a suction formed at a non-connected end of said vent hose will cause movement of air into said suction apertures, through said central suction chamber, through said vent hose fitting, and out through said vent hose when said other of said ports is blocked; and a port plug sealingly connectable with the other of said ports of said vent hose fitting.

2. The commode odor extractor of claim 1, wherein:

U-shaped suction fitting is constructed from a non-conducting plastic.

3. The commode odor extractor of claim 1, wherein:

said lip extends downwardly from said U-shaped suction fitting a distance of about one-half inch.

4. The commode odor extractor of claim 1 wherein:

said central suction chamber extends substantially the entire length of said U-shaped suction fitting.

5. The commode odor extractor of claim 1 wherein:

an area of said suction aperture closest to a center of said U-shaped suction fitting is smaller than the area of said suction aperture farthest away from said center of said U-shaped suction aperture.

6. The commode odor extractor of claim 1 wherein:

said lip defines an entire internal edge of said U-shaped suction fitting.

7. The commode odor extractor of claim 1 wherein:

each of said connecting ports is internally threaded, said vent hose has an end fitting companionately threaded for securement within each of said connecting ports, and port plug is companionately threaded for securement within each of said connecting ports.

8. The commode odor extractor of claim 7 wherein:

an area of said suction aperture closest to a center of said U-shaped suction fitting is smaller than the area of said suction aperture farthest away from said center of said U-shaped suction aperture.

9. The commode odor extractor of claim 8, wherein:

U-shaped suction fitting is constructed from a non-conducting plastic.

10. The commode odor extractor of claim 8, wherein:

said lip extends downwardly from said U-shaped suction fitting a distance of about one-half inch.

11. The commode odor extractor of claim 8 wherein:

said central suction chamber extends substantially the entire length of said U-shaped suction fitting.

12. The commode odor extractor of claim 8 wherein:

said lip defines an entire internal edge of said U-shaped suction fitting.

13. The commode odor extractor of claim 11, wherein:

U-shaped suction fitting is constructed from a non-conducting plastic.

14. The commode odor extractor of claim 11, wherein:

said lip extends downwardly from said U-shaped suction fitting a distance of about one-half inch.

15. The commode odor extractor of claim 11 wherein:

said lip defines an entire internal edge of said U-shaped suction fitting.

16. The commode odor extractor of claim 15, wherein:

U-shaped suction fitting is constructed from a non-conducting plastic.

17. The commode odor extractor of claim 15, wherein:

said lip extends downwardly from said U-shaped suction fitting a distance of about one-half inch.

18. The commode odor extractor of claim 17, wherein:

U-shaped suction fitting is constructed from a non-conducting plastic.

* * * * *